United States Patent [19]

Koyabu

[11] 4,427,373

[45] Jan. 24, 1984

[54] METHOD OF DISCHARGING MATERIAL FROM A ROTARY FURNACE

[75] Inventor: Yukio Koyabu, Niihama, Japan

[73] Assignee: Sumitomo Heavy Industries, Ltd., Tokyo, Japan

[21] Appl. No.: 347,652

[22] Filed: Feb. 10, 1982

[30] Foreign Application Priority Data

Feb. 20, 1981 [JP] Japan ..... 56-24043

[51] Int. Cl.[3] ..... F27B 15/00

[52] U.S. Cl. ..... 432/14; 73/863.81; 141/154; 141/326; 141/350; 159/30

[58] Field of Search ..... 432/1, 14; 159/30; 73/863.81, 863.83, 863.86; 141/154, 326, 327, 350

[56] References Cited

U.S. PATENT DOCUMENTS

| | | | |
|---|---|---|---|
| 3,487,695 | 1/1970 | Haunschild et al. | 73/863.81 |
| 3,598,377 | 8/1971 | Galliers | 73/863.81 |
| 3,675,467 | 7/1972 | Myreen | 73/863.83 |
| 4,315,734 | 2/1982 | Ramesohl et al. | 432/14 |
| 4,354,392 | 10/1982 | Goodell et al. | 73/863.86 |

*Primary Examiner*—John J. Camby

*Attorney, Agent, or Firm*—Flynn, Thiel, Boutell & Tanis

[57] ABSTRACT

A method of discharging material from a rotary furnace is disclosed, which method comprises the steps of feeding the material from a preheater into the rotary furnace under gastight conditions, subjecting the material to heat treatment within the rotary furnace, connecting the inlet port of a container to the discharge opening of the rotary furnace, discharging the material from the rotary furnace while maintaining gastight conditions, and thereafter detaching the container from the rotary furnace.

7 Claims, 7 Drawing Figures

METHOD OF DISCHARGING MATERIAL FROM A ROTARY FURNACE

The present invention relates to a method of discharging material from a rotary furnace, for example, a rotary furnace used for heat treating a sample of a particulate, industrial material.

A sample of a material which has been subjected to a reducing test in a rotary furnace must be discharged and cooled without any possibility of exposure to the ambient air. A number of methods are conventionally employed to discharge a sample of material from a rotary furnace. For example, the material can be discharged by tilting the furnace itself, by raking out the material, by scooping it out, or the like. However, certain drawbacks are encountered in practicing these methods. Specifically, it is difficult to completely remove the material from the furnace while the material is still in the fully reduced condition, because of air leakage or exposure to ambient air. For example, when reduced iron is discharged from a rotary furnace in an iron ore reduction test, it becomes reoxidized because of exposure to air.

Accordingly it is an object of the present invention to provide a method of discharging the material from a rotary furnace rapidly, safely and easily without any possibility that the material will be exposed to air.

According to the present invention, the above object is attained by the steps of fitting an openable and shutable closure device, hereinafter referred to as a valve, into the discharge opening of the rotary furnace with the valve in the shut (closed) position, connecting the top port of a container to the valve, pouring the material from the rotary furnace into the container by opening the valve, then closing the valve and detaching the container from the rotary furnace after the valve is closed, the valve remaining connected to the container in the closed condition.

Other objects and the many advantages of the present invention will be readily appreciated as the apparatus becomes better understood by reference to the following detailed description when considered in connection with the accompanying drawings, wherein.

Figure 3:
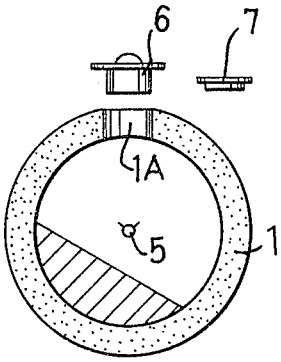
Figure 4:
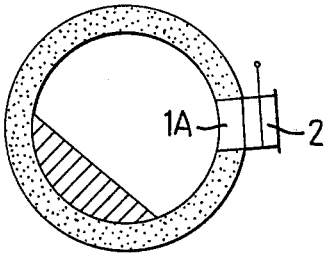
Figure 6:
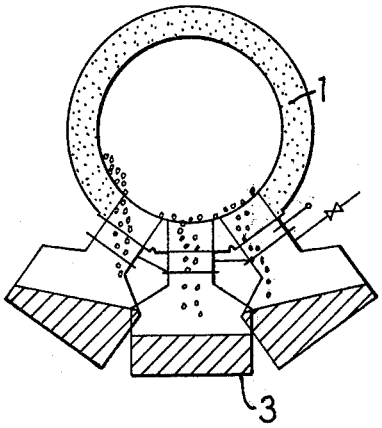
Figure 7:
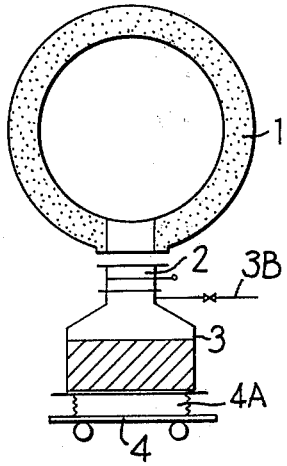

FIG. 3, FIG. 4, FIG, 5, FIG. 6 and FIG. 7 are diagrammatic elevational views showing the sequence of steps by which the material is discharged according to the method of the present invention.

Figure 1:
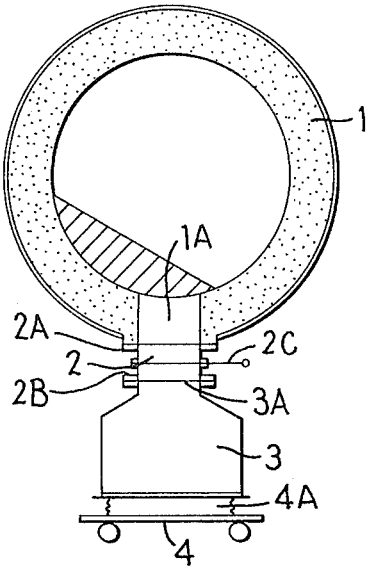
FIG. 1 is an elevational view of an apparatus for practicing the material discharging method of the present invention.
Figure 2:
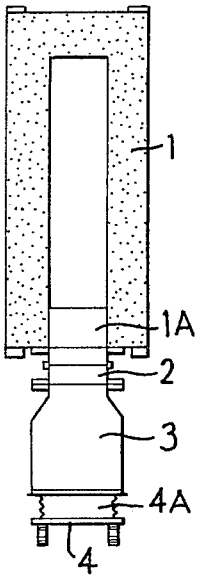
FIG. 2 is a side view of the apparatus shown in FIG. 1.

Referring first to FIGS. 1 and 2, a discharge opening 1A of a rotary furnace 1 is fitted with an openable and shutable valve 2 which defines a flow passage for the material to be discharged from the furnace. A container 3 having a top inlet port 3A is transported toward and away from the furnace on a self-propelled wagon 4 and said container is raised and lowered by means of a lifting device 4A mounted on the wagon 4. In the illustrated embodiment, the valve 2 is a cylindrical casing having upper and lower flanges 2A and 2B adapted to be connected, for example, by bolts, in an airtight fashion to the discharge opening 1A of the furnace 1 and to the top inlet port 3A of the container 3, respectively. The movable closure member of the valve 2 is a laterally slidable plate 2C. The reference numeral 3B (FIGS. 6 and 7) indicates a conduit for supplying inert gas to the container 3.

In the above-described arrangement, a discharging operation, according to the method of the invention, is conducted according to the following sequence of steps. The discharging operation follows the steps of feeding the material to be treated from a preheater to the rotary furnace 1 under gastight conditions and subjecting the material to a test treatment, such as heating under a reducing atmosphere, within the rotary furnace.

(1) After completion of a test treatment, the burner 5 (see FIG. 3) is extinguished and an inert gas, such as $N_2$, is blown into the rotary furnace 1 to establish an inert atmosphere therein.

(2) The furnace 1 is rotated to a position in which the discharge opening 1A is uppermost, as shown in FIG. 3. The plug 6, which was fitted into the discharge opening 1A during the test treatment, is removed by lifting means, such as a hoist or crane, and a temporary, lightweight, heat-insulating lid 7 is fitted into the opening 1A in place of the plug 6 (refer to FIG. 3).

(3) The rotary furnace 1 is rotated through an angle of about 90 degrees to the position shown in FIG. 4 wherein the discharge opening 1A extends substantially horizontally. While the furnace is in this position, the temporary lid 7 is removed and the open-and-shut valve 2, which is in the shut (closed) position, is attached to the discharge opening 1A (refer to FIG. 4) in the airtight fashion. The furnace is rotated by about 90 degrees to position the discharge opening 1A in the position shown in FIG. 4, before the valve 2 is attached, because the influence of heat is minimized when the furnace is in that position.

Figure 5:
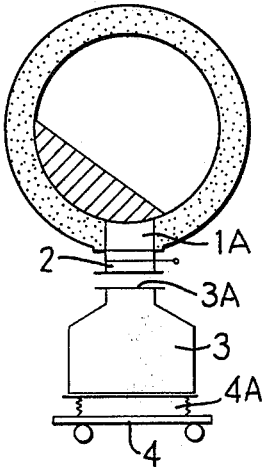

(4) The rotary furnace 1 is rotated further through an angle of 90 degrees and is stopped in the position in which the valve 2 is positioned at the bottom of the rotary furnace 1 so as to extend downwardly. Meanwhile, a container 3 is carried by the self-propelled wagon 4 to a position directly below the valve 2 (refer to FIG. 5). The container 3 can be filled with an inert gas by means of the conduit 3B.

(5) The container 3 is raised by means of the lifting device 4A and the top inlet port 3A thereof is connected in an airtight manner with the mating part of the valve 2. When the lifting device 4A is lowered, the container 3 remains connected to the valve 2. Thus, the container 3 is integrally supported by the rotary furnace 1.

(6) The valve 2 is opened to allow the material in the rotary furnace 1 to be poured into the container 3. Then the rotary furnace 1 is rotated back and forth (that is, moved in the clockwise and counter-clockwise directions alternately) to move the furnace 1 and the container 3 through an angle of from about 20 to about 30 degrees so that the material will be discharged from the furnace in its entirety (refer to FIG. 6).

(7) Subsequent to the completion of the discharge of the material sample, the valve 2 is closed, and the container 3 is again supported from below by raising the lifting device 4A.

(8) The valve 2 is detached from the rotary furnace 1 and then the lifting device 4A is lowered so that the container 3 is separated from the rotary furnace. During the course of this operation of container 3 remains closed by means of the valve 2 (refer to FIG. 7).

(9) When the container 3 is transported by the self-propelled wagon 4, the material within the container 3 can be cooled gradually with an inert gas or cooled rapidly within a water bath while maintaining a gastight condition under which the samples of the material are enclosed within the container 3.

As described above, the present invention provides a novel method by which the rapid, safe and easy discharge of a hot sample of the material in a rotary furnace can be accomplished within an inert gas atmosphere and without exposure to air. Moreover, cooling can be accomplished easily because the container filled with the sample of the material is sealed and thus is gastight.

What is claimed is:

1. A method of treating and then discharging material from a rotary furnace having a discharge opening, comprising the steps of: feeding material from a preheater into the rotary furnace under gastight conditions; then subjecting said material to heat treatment within said rotary furnace while maintaining gastight conditions therein; connecting one end of an openable and shutable valve to the discharge opening of said rotary furnace while said valve is shut and while maintaining gastight conditions in said furnace, said valve defining a gastight material flow passage for discharging said material from said furnace; then connecting the inlet port of a container to the opposite end of said valve while maintaining gastight conditions in said furnace, thereby making a secure gastight connection between the inlet port of said container and the discharge opening of said rotary furnace; then opening said valve; and discharging said material from said furnace through said material flow passage into said container while maintaining gastight conditions in said furnace, said flow passage and said container; then closing said valve; and then detaching said valve from said furnace while maintaining gastight conditions in said container.

2. A method as set forth in claim 1, wherein said container is of the self-propelled type.

3. A method as set forth in claim 1, wherein after said valve is opened, said rotary furnace is rotated in the clockwise and counterclockwise directions alternately, thereby swinging said container which is rigidly attached to said rotary furnace by means of said valve.

4. A method according to claim 1 or claim 2, wherein said furnace is of the self-propelled type.

5. A method of treating and discharging material from a rotary furnace having a discharge opening having a plug therein, said furnace being rotatable about a horizontal axis, comprising the steps of: feeding material from a preheater into the rotary furnace under gastight conditions; then rotating said furnace and subjecting said material to heat treatment within said rotary furnace while maintaining gastight conditions therein; stopping rotation of said furnace when said furnace is positioned so that said discharge opening faces upwardly and then removing the plug from said discharge opening; fitting a temporary lid made of a light-weight material into said discharge opening in place of said plug whereby to seal said discharge opening; rotating said rotary furnace so as to position said discharge opening, having said temporary lid fitted therein, so that said discharge opening faces sidewardly; then removing said temporary lid from said discharge opening; then connecting one port of an open-and-shut valve to said discharge opening in place of said temporary lid, said valve being in a shut condition so as to maintain said furnace under gastight conditions; connecting the other port of said open-and-shut valve to the inlet port of a container in a gastight condition, said container being filled with an inert gas; then opening said open-and-shut valve and discharging said material from said rotary furnace while maintaining gastight conditions in said furnace and said container; then closing said valve and detaching said container and said valve from said rotary furnace while maintaining gastight conditions in said container.

6. A method as set forth in claim 5, in which said valve is connected to the inlet port of said container by rotating said rotary furnace, after connecting said open-and-shut valve in a closed position thereto, to a position in which said valve faces downwardly; moving a self-propelled container, before, during, or after said step of positioning said valve so that it faces downwardly, to a position in which the inlet port of said self-propelled container is located directly below said valve; and thereafter moving said container upwardly in order to connect the inlet port of said container to said open-and-shut valve.

7. A method as set forth in claim 6, further comprising the step of filling said rotary furnace and said container with an inert gas prior to and during the discharge of said sample of material from said rotary furnace into said container.

* * * * *